US007726991B2

(12) United States Patent
Ma et al.

(10) Patent No.: US 7,726,991 B2
(45) Date of Patent: Jun. 1, 2010

(54) ELECTRICAL CARD CONNECTOR WITH A WEDGE-SHAPED BLOCK

(75) Inventors: Zhong-Jun Ma, ShenZhen (CN); Nan Hu, ShenZhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/386,622

(22) Filed: Apr. 21, 2009

(65) Prior Publication Data

US 2009/0263996 A1 Oct. 22, 2009

(30) Foreign Application Priority Data

Apr. 21, 2008 (CN) ..... 2008 2 0034875 U

(51) Int. Cl.
*H01R 29/00* (2006.01)

(52) U.S. Cl. ..... 439/188; 439/630

(58) Field of Classification Search ..... 439/188, 439/630

See application file for complete search history.

(56) References Cited

U.S. PATENT DOCUMENTS 6,135,809 A * 10/2000 Asakawa ..... 439/489
6,159,028 A * 12/2000 Bernardet et al. ..... 439/188
6,296,500 B1 * 10/2001 Liao ..... 439/188
6,435,887 B2 * 8/2002 Koitsalu ..... 439/188
6,478,595 B2 * 11/2002 Nishioka ..... 439/188
6,485,319 B2 * 11/2002 Bricaud et al. ..... 439/188
6,652,300 B2 * 11/2003 Nishioka ..... 439/159
6,688,899 B2 * 2/2004 Rumpel ..... 439/188
7,112,077 B2 * 9/2006 Kikuchi ..... 439/188
7,435,116 B2 * 10/2008 Wang ..... 439/188
7,435,119 B2 * 10/2008 Chang et al. ..... 439/188
7,503,805 B2 * 3/2009 Chang et al. ..... 439/630
7,588,467 B2 * 9/2009 Chang ..... 439/630
7,635,276 B1 * 12/2009 Chu et al. ..... 439/326
2001/0014549 A1 * 8/2001 Martucci et al. ..... 439/188
2002/0045372 A1 * 4/2002 Rumpel ..... 439/188
2005/0059281 A1 * 3/2005 Bricaud et al. ..... 439/188
2006/0079106 A1 * 4/2006 Kikuchi ..... 439/188
2008/0124979 A1 * 5/2008 Chang ..... 439/630

* cited by examiner

*Primary Examiner*—Ross N Gushi
(74) *Attorney, Agent, or Firm*—Ming Chieh Chang; Wei Te Chung; Andrew C. Cheng

(57) ABSTRACT

A card connector, comprising: an insulative housing having a base, a first passageway and a second passageway defined adjacently in the base; a plurality of contacts held within the base, the contacts having contact sections extending beyond the base; a pair of detecting switches including a stationary switch and a movable switch respectively located in the first passageway and the second passageway communicating with each other; the movable switch including a planar section abutting against a bottom wall of the second passageway, and a slanted spring arm attached to planar section, the slanted spring arm defining a contact end; a wedge-shaped block extending into the second passageway with a wedgy surface defined thereon, the slanted spring arm constantly contacting with said wedgy surface such that there is no portion of said spring arm electrically engages with the stationary switch when said contact end is pushed by an external force.

14 Claims, 6 Drawing Sheets

ELECTRICAL CARD CONNECTOR WITH A WEDGE-SHAPED BLOCK

BACKGROUND OF THE INVENTION

1. Field of the invention

The present invention relates to an electrical card connector, and more particularly, to an electrical card connector provided with a wedge-shaped block for preventing the electrical card from be upwarped when pushed in the receiving passageway.

2. Description of Related Art

Electrical cards are known in the art and contain intelligence in the form of a memory circuit or other electronic program. Some form of card readers retrieve the information or data stored on the card. Such cards are used in many applications in today's electronic society, including video cameras, digital still cameras, smart phones, PDAs, music players, ATMs, cable television decoders, toys, games, PC adapters, multi-media cards and other electronic applications, etc.

Example of prior art card-receiving connectors shown as FIG. 6 includes an insulative housing 1' having a base 10', a first passageway and a second passageway are defined adjacently in the base 10'; a stationary switch 32' and a movable switch 31' are defined in the first passageway and the second passageway respectively. The movable switch 31' has a supporting section 311' extended from a planar section 310', the planar section 310' locates on the bottom of the second passageway, and a free end of the supporting section 311' defines a first contact section 313' extended above the second passageway. The second passageway defines a rectangular receiving space 117'; the supporting section 311' and the planar section 310' are received in the rectangular receiving space 117'. Inserting a electrical card into the electrical card connector, the first contact section 313' is pushed by the card, and then the supporting section 311' moves downwardly and is separated with the second contact section 324' of the stationary switch 32'. A change of electricity is caused by the connection and the separation between the first and the second contact section for showing whether the electrical card is inserted perfect.

But something always happens as follow: The planar section 310' and the supporting section 311' always upwarp and nothing could support the supporting section 310' of the movable switch 31', when the electrical card is inserted well, the first and the second contact section are not separated from each other. A wrong signal will be given of whether the electrical card is inserted well.

Therefore, an improved electrical card connector is desired to overcome the disadvantages of the prior arts.

SUMMARY OF THE INVENTION

An object, therefore, of the invention is to provide a new and improved electrical card connector of the character described able to ensure that the first contact section and the second contact section is separated from each other when the electrical card is inserted well.

In order to achieve the above-mentioned object, a card connector comprising: an insulative housing having a base, a first passageway and a second passageway defined adjacently in the base; a plurality of contacts held within the base, the contacts having contact sections extending beyond the base; a pair of detecting switches including a stationary switch and a movable switch respectively located in the first passageway and the second passageway communicating with each other; the movable switch including a planar section abutting against a bottom wall of the second passageway, and a slanted spring arm attached to planar section, the slanted spring arm defining a contact end; a wedge-shaped block extending into the second passageway with a wedgy surface defined thereon, the slanted spring arm constantly contacting with said wedgy surface such that there is no portion of said spring arm electrically engages with the stationary switch when said contact end is pushed by an external force.

Other objects, advantages and novel features of the present invention will become more apparent from the following detailed description of the present embodiment when taken in conjunction with the accompanying drawings.

DETAILED DESCRIPTION OF THE INVENTION

Figure 1:
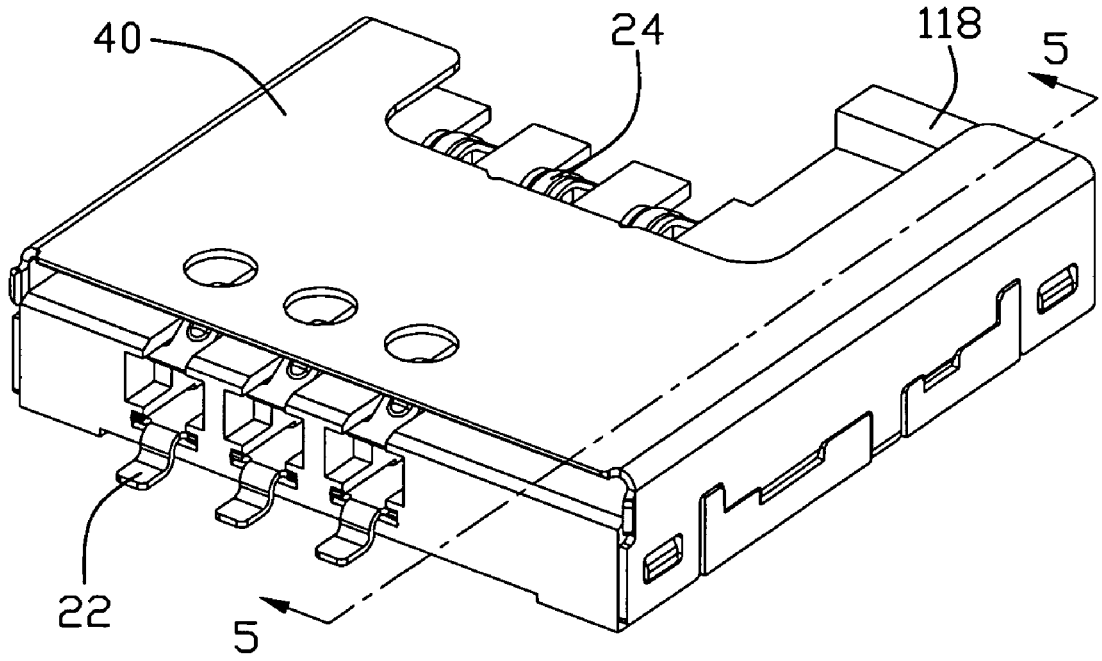
FIG. 1 is an assembled, perspective view of an electrical card connector according to an embodiment of the present invention.

Reference will now be made in detail to the preferred embodiment of the present invention.

Referring to FIGS. 1-5, an embodiment of the present invention illustrated. An electrical card connector 100 for electrically connecting an electrical card comprises an insulative housing 1 with a plurality of terminals 2 assembled therein; a detecting switch 3 defined in the insulative housing 1; and a shield shell 4 covering the insulative housing 1.

Figure 2:
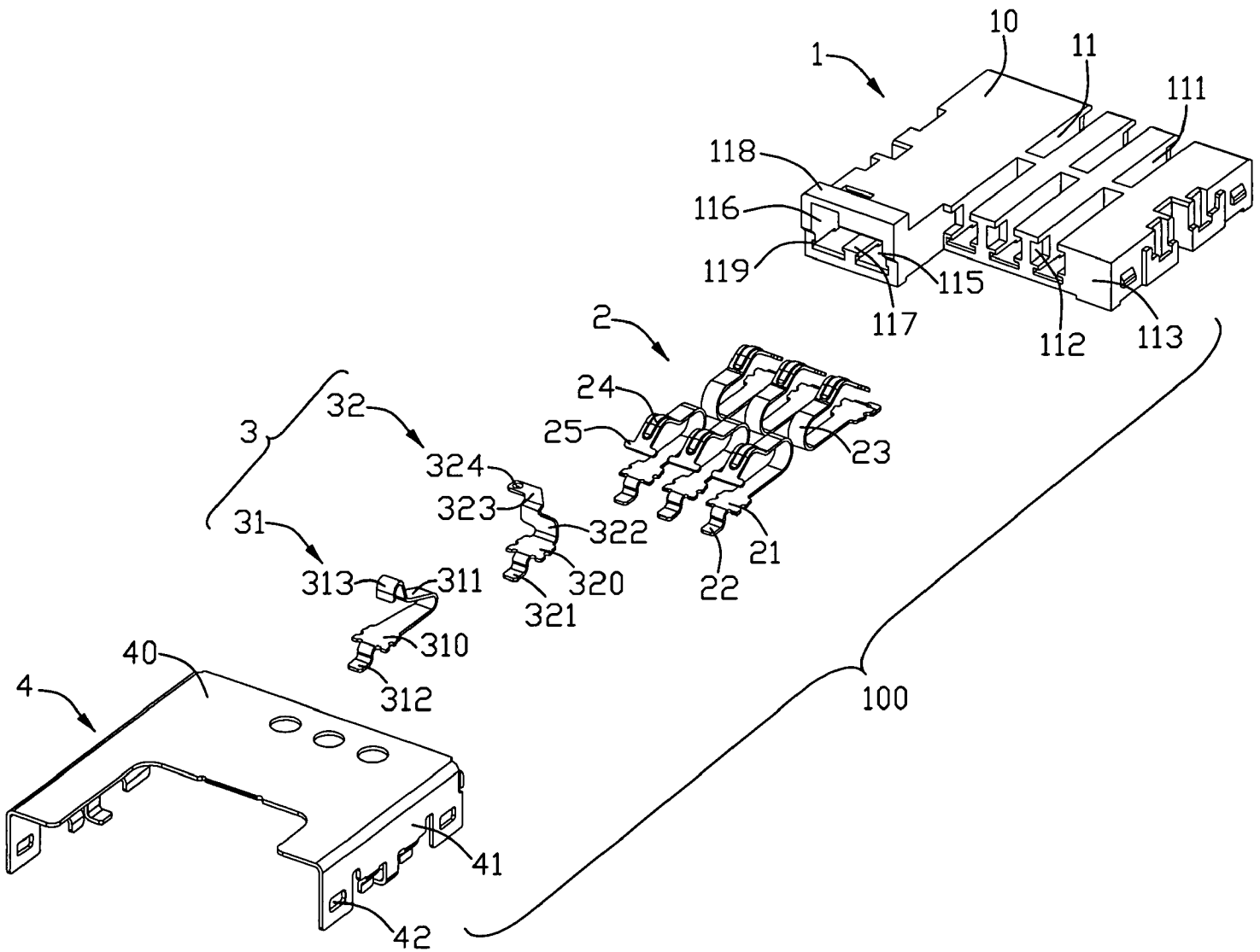
FIG. 2 is an exploded, perspective view of the electrical card connector as shown in FIG. 1.
Figure 3:
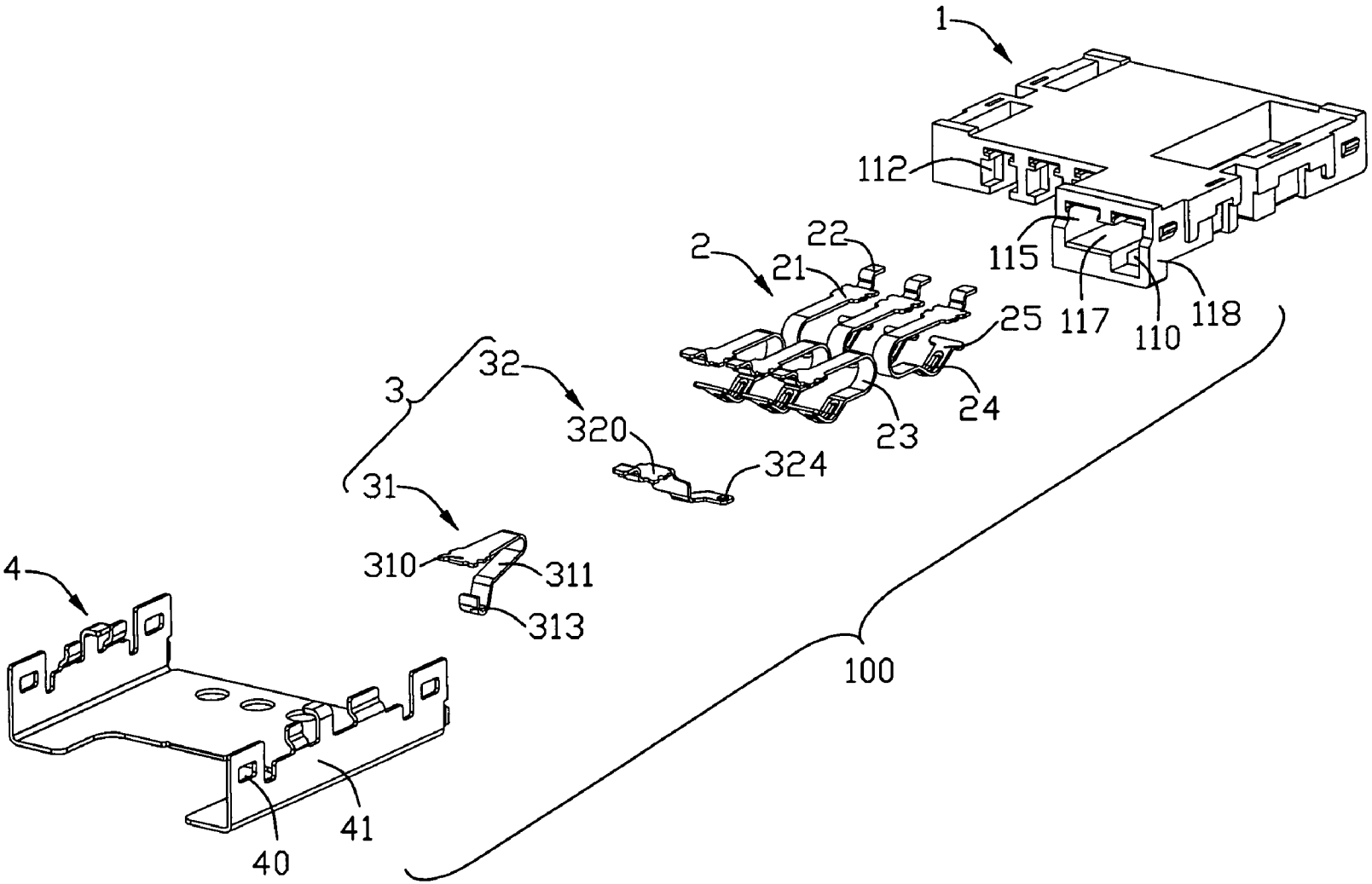
FIG. 3 is an exploded, perspective view of the electrical card connector as shown in FIG. 1 from another aspect.
Figure 4:
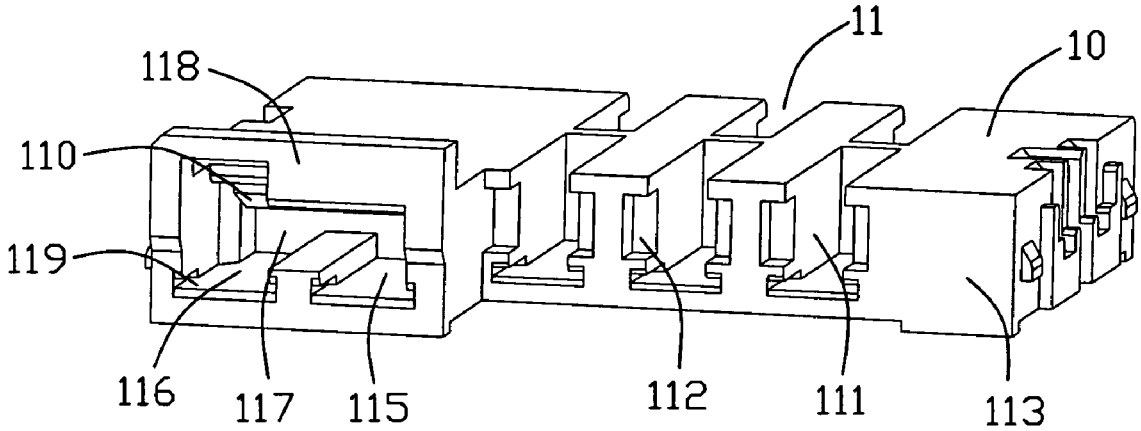
FIG. 4 is a perspective view of an insulative housing of the electrical card connector as shown in FIG. 1.

Referring to FIGS. 2, 3 and 4, the insulative housing 1 includes a base 10. The base 10 defines a plurality of terminal receiving passageways 11 with the terminals 3 received therein. A notch 112 is defined in each sidewall 111; the notch 112 runs through the outer surface 113 of the base 10. A first passageway 115 and a second passageway 116 are defined in the base adjacently, and the first passageway 115 is connected with the second passageway 116. An opening 117 is defined by the first passageway 115 and the second passageway 116 on the base 10, and a beam section 118 which is above said opening 117 on the base 10 is defined; the beam section 118 can stop the card when the card is inserted. A wedge-block 110 is defined in the second passageway 116 with a wedge-surface defined thereon. A pair of grooves 119 is defined on the bottom of the first passageway 115 and the second passageway 116 respectively.

The terminals 2 are received in the terminal receiving passageways 11. Each terminal includes a first planar portion 21, a first soldering tail 22 and a first resilient section 23 are defined on two ends of the planar section 21, and the free end of the resilient section 23 has a first contact section 24. A pressing section 25 extending vertically to the sidewall 111 of the terminal receiving passageway 11 is defined on the free end of the contact section 24.

Figure 5:
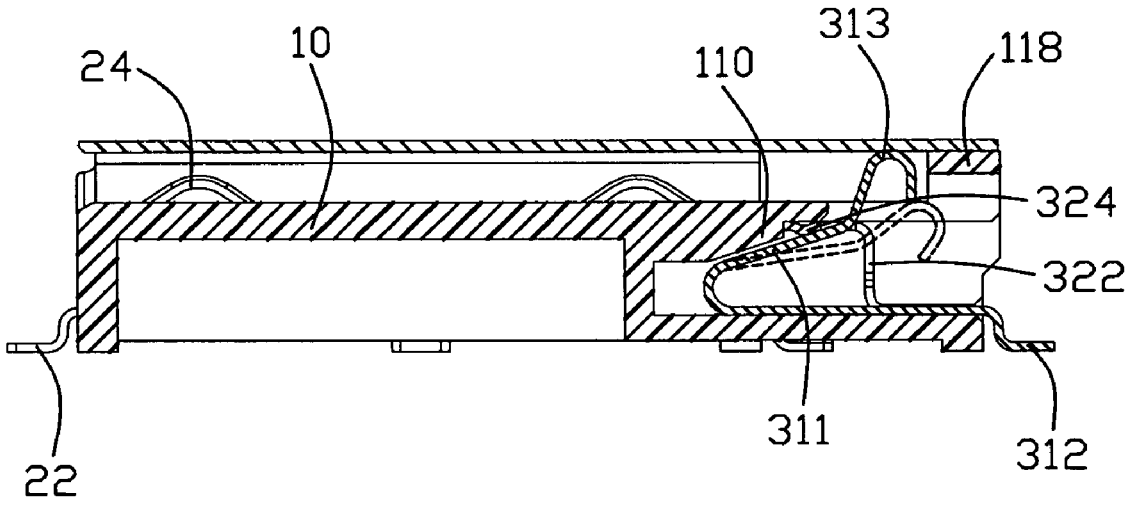
FIG. 5 is a cross sectional view showing an inner structure of the electrical card connector of FIG. 1.
Figure 6:
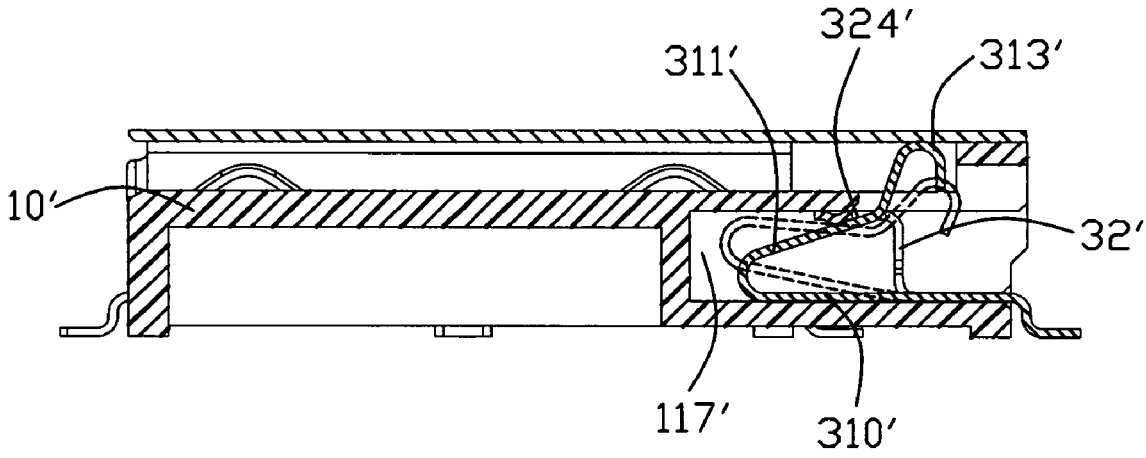
FIG. 6 is a cross sectional view showing a conventional card connector.

Referring to FIGS. 2, 3 and 5, the detecting switch 3 includes a movable switch 31 and a stationary switch 32. The movable switch 31 includes a second planar section 310, a supporting section 311 is defined on an end of the second planar section 310. A second soldering tail 312 is defined on the other end of the second planar section 310. The supporting section 311 has a second contact section 313 on the free end. The stationary switch 32 includes a third planar section 320, a third soldering tail 321 and a connecting section 322 are defined on the two ends of the third planar section 320, and a third contact section 323 which is parallel with the third planar section 320 is defined on the end of the connecting section 322. A dimple 324 is defined on the third contact section 323.

The shield shell 4 includes a top section 40, a pair of side arms 41 extend from the opposite sides of the top section 40, the retention holes 42 are defined on the side arms 41.

When assembly, the terminals 2 are received in the terminal receiving passageways 11, the pressing section 25 is hold in the notch 112 correspondingly. The movable switch 31 is received in the second passageway 116; the stationary switch 32 is received in the first passageway 115. The second planar section 310 and the third planar section 320 are received in the grooves 119 correspondingly. The shield shell 4 is assembled on the base 10. The stationary switch 32 electrically connects with the movable switch 31 through the touch between the dimple 324 and the supporting section 311. Inserting the electrical card into the electrical card connector 100, the second contact section 313 is pushed by the electrical card, making the second contact section 313 and the supporting section 311 move downwardly and separate from each other. The supporting section 311 is pushed against the wedge-surface of the wedge-block 110 during the inserting process of the electrical card.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. A card connector, comprising:

an insulative housing having a base, a first passageway and a second passageway defined adjacently in the base;

a plurality of contacts held within the base, the contacts having contact sections extending beyond the base;

a pair of detecting switches including a stationary switch and a movable switch respectively located in the first passageway and the second passageway communicating with each other; the movable switch including a planar section abutting against a bottom wall of the second passageway, and a slanted spring arm attached to planar section, the slanted spring arm defining a contact end;

a wedge-shaped block extending into the second passageway with a wedgy surface defined thereon, the slanted spring arm constantly contacting with said wedgy surface such that there is no portion of said spring arm electrically engages with the stationary switch when said contact end is pushed by an external force.

2. The card connector as described in claim 1, wherein the insulative housing includes a plurality of terminal receiving passageways with said contacts received therein, each terminal receiving passageway defining two notches on the two sidewalls.

3. The card connector as described in claim 2, wherein each contact includes a pressing section extending vertically to a sidewall of the terminal receiving passageway, said pressing section is held in the notch correspondingly.

4. The card connector as described in claim 1, wherein a groove is defined on the bottom of each sidewall, the planar section of each contact is fixed through said groove.

5. The card connector as described in claim 1, wherein an opening is defined by the first passageway and the second passageway on a side of the base, and a beam section which is above said opening is defined on the base.

6. The card connector as described in claim 1, wherein the stationary switch includes a bending section with a contact protrusion section defined thereon.

7. The card connector as described in claim 6, wherein the bending section extends into the first passageway from the second passageway, the contact protrusion contacts the supporting section when assembly.

8. The card connector as described in claim 1, wherein the card connector further includes a metal cover.

9. A card connector for use with an electronic card, comprising:

an insulative housing defining a card receiving space;

a plurality of terminals disposed in the housing with contacting sections extending into the card receiving space for mechanical and electrical engagement with the card;

a switch contact set including a moveable contact and an immovable contact mechanically and electrically engaged with each other when no card is inserted into the card receiving space, said moveable contact, which is configured to be actuated by the electronic card, including a deflectable section backwardly extending from a stationary section, said deflectable section including a first segment extending from the stationary section in a first angle direction and a second segment extending from the first segment in a second angle direction, which is steeper than the first angle direction, with thereof a contact portion extending into the card receiving space, wherein the housing defines a downwardly facing wedge section extending essentially along a lengthwise direction of said first segment when no card is received in the card receiving space.

10. The card connector as claimed in claim 9, wherein the wedge section is spaced from the first segment with a gap when no card is received in the card receiving space.

11. The card connector as claimed in claim 9, wherein engagement between the moveable contact and the immovable contact occurs at a position intimately on the wedge section.

12. A card connector for use with an electronic card, comprising:

an insulative housing defining a card receiving space;

a plurality of terminals disposed in the housing with contacting sections extending into the card receiving space for mechanical and electrical engagement with the card;

a switch contact set including a moveable contact and an immovable contact mechanically and electrically engaged with each other when no card is inserted into the card receiving space, said moveable contact, which is configured to be actuated by the electronic card, including a deflectable section backwardly extending from a stationary section, said deflectable section including a first segment extending from the stationary section in a first angle direction and a second segment extending from the first segment in a second angle direction, which is steeper than the first angle direction, with thereof a contact portion extending into the card receiving space, wherein the housing defines a downwardly facing wedge section, and a joint between the deflectable section and the stationary section is intimately located beside said wedge section so as to assure said joint can not be upwardly moved during downward deflection of the deflectable section, and no engagement between the moveable contact and the immoveable contact when the electronic is received in the card receiving space.

13. The card connector as claimed in claim 12, wherein the wedge section is spaced from the first segment with a gap when no card is received in the card receiving space.

14. The card connector as claimed in claim 12, wherein engagement between the moveable contact and the immovable contact occurs at a position intimately on the wedge section.

* * * * *